United States Patent [19]

Sandomeno

[11] Patent Number: 4,801,034

[45] Date of Patent: Jan. 31, 1989

[54] STRUCTURE FOR STORING RECYCLABLE TRASH MATERIALS

[76] Inventor: Laura Sandomeno, 123 Morningside Rd., Verona, N.J. 07044

[21] Appl. No.: 108,940

[22] Filed: Oct. 9, 1987

[51] Int. Cl.[4] ..... B65D 1/36

[52] U.S. Cl. ..... 220/23.83; 220/1 T; 220/23; 220/94 R

[58] Field of Search ..... 220/23.83, 1 T, 20, 220/22, 23, 95, 94 R, 94 B; 229/120.01, 120.02, 120.09, 120.11, 120.37

[56] References Cited

U.S. PATENT DOCUMENTS

| | | | |
|---|---|---|---|
| 2,989,221 | 6/1961 | Butler | 229/120.37 |
| 3,402,848 | 9/1968 | Busey | 220/1 T |
| 3,893,615 | 7/1975 | Johnson | 220/1 T |

FOREIGN PATENT DOCUMENTS

| | | | |
|---|---|---|---|
| 3024822 | 1/1982 | Fed. Rep. of Germany | 220/1 T |

*Primary Examiner*—Willis Little

*Attorney, Agent, or Firm*—Anthony F. Cuoco

[57] ABSTRACT

There is disclosed herein structure for storing recyclable trash materials which includes a container divided into a plurality of compartments. Each of the compartments is adapted to receive a receptacle. Each of the receptacles contains a different kind of trash. The receptacles have a handle which is substantially upright to grasp the receptacle and conforms to the receptacle when the receptacle is in the container. The container rests on a base which has an open front with a shelf for storing flat paper articles and the like.

8 Claims, 2 Drawing Sheets

STRUCTURE FOR STORING RECYCLABLE TRASH MATERIALS

BACKGROUND OF THE INVENTION

Trash disposal is a problem facing most municipal, county and state governments. Presently, household trash such as cans, paper, bottles and the like is collected periodically and deposited in dumps or land areas and the like which are to be filled in to cover the deposited trash. Available trash depositories are being rapidly filled by the constantly increasing amount of trash. Accordingly, it has become necessary to develop alternate methods of trash disposal.

One such alternate method which is gaining increased attention involves recycling the trash materials. Recycling involves processing each different trash material to a re-useable form. However, recycling necessitates segregation of the various kinds of trash materials so that they can be appropriately processed.

Segregation of trash can be most effectively accomplished at the source of the trash, i.e. in the home. Indeed some states have already enacted legislation mandating segregation of trash at the home before it is collected so as to enhance recycling procedures. In view of the above it is becoming increasingly important that a structure be available for use in the home, either inside or outside, so that the various types of trash can be segregated and stored prior to collection.

A patent search in Class D34 Subclass 7; Class D34 Subclass 8; and Class 220 Subclass 1T, has made the present inventor aware of U.S. Pat. Nos. 3,904,218; 3,720,346; 3,385,465; D241,112; and D275,618.

U.S. Pat. Nos. D241,112; D275,618 and 3,385,465 merely disclose various containers having only a general structural relevance to the present invention.

U.S. Pat. No. 3,904,218 relates to a rotatably mounted platform for supporting a plurality of trash cans of like configuration, each of which complements the other.

U.S. Pat. No. 3,720,346 relates to a trash receptacle having an adjustable inner partition which defines separate trash compartments for different trash materials. The present invention is seen to distinguish over the structure described in these patents and is seen to be an improvement thereover as will hereinafter become evident.

SUMMARY OF THE INVENTION

The present invention contemplates structure for storing recyclable trash materials and segregating same at the source, i.e. in the home, either inside or outside. The structure features a container which is partitioned into a plurality of compartments. Each of the compartments is adapted to receive a removable receptacle. Each of the receptacles is intended to contain a different type of trash. Each of the receptacles has a handle which is mounted to the receptacle so as to be displaced to a substantially upright position suitable for grasping the receptacle when it is desired to insert or remove same from the container, and to a position so as to conform to the receptacle when the receptacle is stored within the container. The container has a hinged cover at its open top to open and close the container and is supported by a base. The base has a shelf at its bottom for storing and segregating newspapers and other like flat paper materials.

Accordingly, there is disclosed and claimed herein structure for storing recyclable trash materials, comprising: a container having an open top; a base for supporting the container and having an open front; a shelf disposed in the open front for storing flat, newspaper-like trash; a cover arranged with the top of the container for opening and closing said container; means for partitioning the interior of the container into a plurality of compartments; a corresponding plurality of receptacles, each of which receptacles has an open top and is designated to receive a different type of recyclable trash; and means arranged with each of the receptacles for grasping the receptacle to store said receptacle in its respective compartment and for removing said receptacle therefrom.

DETAILED DESCRIPTION OF THE INVENTION

A container substantially rectangular in cross-section is designated by the numeral 2. Container 2 which is otherwise closed has an open top 3 and a cover 4 is hinged at the top rear of the container by hinges 6. Hinges 6 are shown for purposes of illustration as external to the container and cover. It will be understood that the hinges can be internal to the container and cover as well, as may be esthetically desirable. Further, although the cover is hinged at the rear of the container, it may be hinged at the container side, the same being contemplated by the invention.

Figure 3:
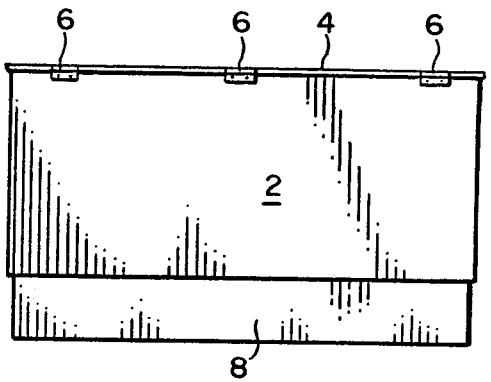
FIG. 3 is a rear elevation view thereof.
Figure 2:
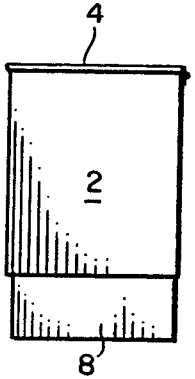
FIG. 2 is a right side elevation thereof.
Figure 1:
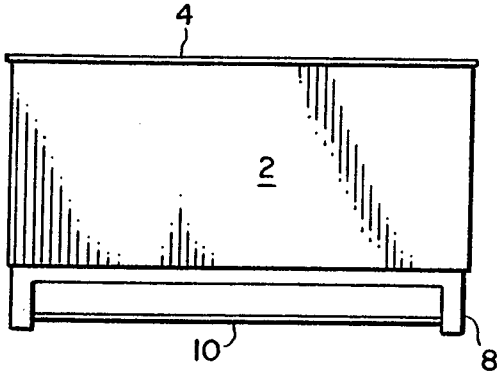
FIG. 1 is a front elevation view particularly showing the structure of the invention when the container is closed.

Container 2 is supported by a base 8 which, in the preferred embodiment of the invention, is formed integral with the container. Base 8 is closed at its rear and sides (FIGS. 2, 3 and 5), and is opened at its front (FIGS. 1 and 5) for supporting a shelf 10. Shelf 10 is used for storing newspapers and other like flat paper materials separate from other trash stored within receptacles disposed in container 2 as will be hereinafter described.

It will be understood that cover 4 is flush with the back of container 2. The sides of the cover and the front thereof overhang the container. Likewise container 2 overhangs the front, rear and sides of base 8. The aforenoted overhangs are in an amount consistent with the desired esthetic characteristics of the structure described, as will now be understood.

Figure 4:
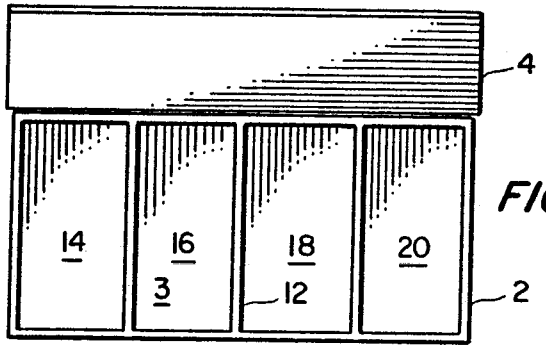
FIG. 4 is a top plan view of the structure when the container is open, and when the receptacles are not in the container.

Container 2 has a partitioning frame 12 therein which, in the preferred embodiment of the invention, is integral with the container. Frame 12 separates the interior of container 2 into a plurality of compartments shown, for purposes of example, as four in number and designated in FIGS. 4 and 5 by the numerals 14, 16, 18 and 20. Each of the compartments 14, 16, 18 and 20 is rectangular in cross-section and receives a receptacle such as that designated by the numeral 22 in FIG. 5. In this connection it will be readily understood that the several compartments 14, 16, 18 and 20 are larger than the respective receptacles 22 so that the receptacles may be easily inserted and removed from the compartments, and so that cover 4 can properly close the container.

Figure 5:
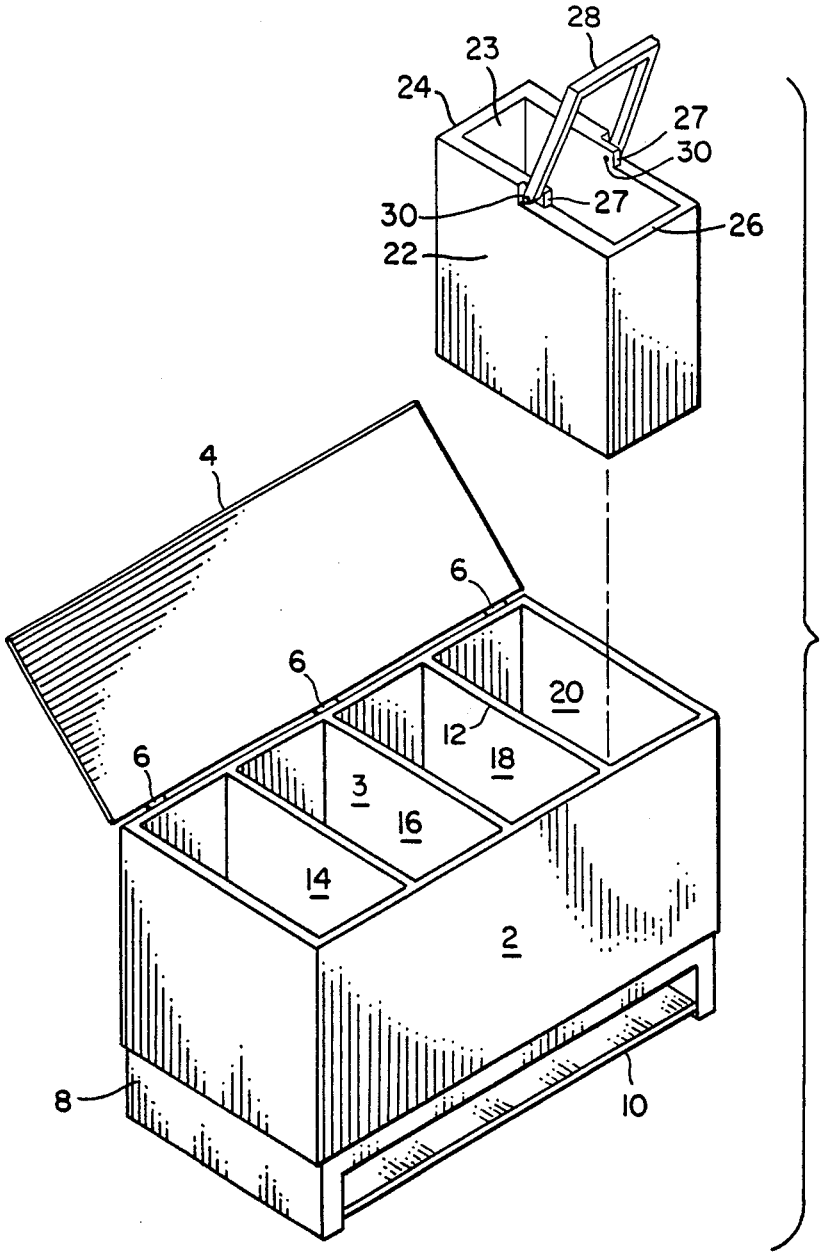
FIG. 5 is an exploded view of the structure showing the container when the container is open, and particularly showing one of the receptacles which is stored in the container.

As shown in FIG. 5, receptacles 22 are substantially rectangular in cross-section so as to conform to compartments 14, 16, 18 and 20 and are closed except for an open top 23 having an edge 24 extending along the rear and partially along the sides thereof. The receptacles include a ledge or the like 26 below edge 24 and extending therefrom along the sides and front of the receptacles. Edge 24 terminates in ears 27 on the opposite sides thereof.

A generally U-shaped handle 28 is journaled in ears 27 by journals 30 so as to be displaceable thereabout to a substantially upright position as shown in FIG. 5, wherein the receptacle may be grasped for insertion in or removal from a container compartment, and to a position so as to rest on ledge 26 when the receptacle is positioned in a container compartment for storage. In this latter position handle 28 conforms to ledge 26.

In using the invention, receptacles 22 with handles 28 in the substantially upright position are grasped to be positioned in the respective compartments 14, 16, 18 and 20 of container 2. Thereafter handle 22 is lowered so as to rest on and conform to ledge 26 as aforenoted.

With receptacles 22 thus positioned in their respective compartments, cover 4 is normally lowered to close the container. When disposing of trash, cover 4 is raised and the segregated trash is put in an appropriate receptacle 22. Thus, one receptacle 22 may be dedicated to receiving cans, another to receiving plastic articles, another to receiving bottles, etc. Newspapers or other like flat paper items are stored on shelf 10.

When a particular receptacle 22 is full, cover 4 is raised to open the container and the receptacle is removed from container 2 via handle 28 being displaced to the substantially upright position, and transferred to a collection location or to a designated recycling station, as the case may be.

Although it is contemplated that the structure of the invention as heretofore described will be fabricated, as by molding or the like, from a durable plastic material such as polyurethane, it will be understood that the structure may likewise be fabricated from other materials such as wood or metal, as may be indicated by the intended use of the invention.

Suitable esthetic characteristics can be incorporated into the structure for rendering it attractive for indoor and outdoor household use, as the case may be. The structure may be of various sizes to accomodate available space and various trash disposal requirements as will now be understood.

There has thus been described a structure for storing recyclable trash materials which is easy to use and is adaptable for both indoor and outdoor use at the originating site of the trash, i.e. the home. While container 2, compartments 14, 16, 18, 20 and receptacles 22 have been described as being substantially rectangular in shape other configurations are within the contemplation of the invention. Further, each of the receptacles 22 may be marked or otherwise coded or identified for the specific type of trash that they are to contain. The number of compartments and receptacles may be increased or decreased in accordance with particular requirements.

With the aforegoing description of the invention in mind reference is made to the claims appended hereto for a definition of the scope of the invention.

What is claimed is:

1. Structure for storing recyclable trash materials, comprising:

a container having an open top;

a base for supporting the container and having an open front;

a shelf disposed in the open front for storing flat, newspaper-like trash;

a cover arranged with the top of the container for opening and closing said container;

means for partitioning the interior of the container into a plurality of compartments;

a corresponding plurality of receptacles, each of which receptacles has an open top and is designated to receive a different type of recyclable trash, each of said receptacles including a ledge near the top of the receptacle and extending at least partially along the sides from the front to the rear thereof, and extending along the front of the receptacle;

means arranged with each of the receptacles for grasping the receptacle to store said receptacle in its respective compartment and for removing said receptacle therefrom, and including a generally U-shaped handle supported by the receptacle so as to be displaceable to a first position for grasping the receptacle to store said receptacle in its respective compartment and to remove said receptacle therefrom, and displaceable to a second position when the receptacle is stored in said compartment; and the handle being substantially upright and above said ledge when it is in the first position, and resting on and conforming to said ledge when it is in the second position.

2. Structure as described by claim 1, wherein:

the base is integral with the container.

3. Structure as described by claim 1, wherein:

the partitioning means is integral with the container.

4. Structure as described by claim 1, wherein:

the container, the compartments and the receptacles are substantially rectangular in cross-section.

5. Structure as described by claim 1, wherein:

the cover overhangs the front and sides of the container when the container is closed; and the container overhangs the front, rear and sides of the base.

6. Structure for storing recyclable trash materials, comprising:

a container substantially rectangular in cross-section and having an open top;

a base integral with the container and having an open front;

a shelf disposed in the open front for storing, flat newspaper-like trash;

a cover hinged at the top of the container for opening and closing said container;

a frame integral with the container for partitioning the interior thereof into a plurality of compartments, each of which has substantially rectangular cross-section;

a corresponding plurality of receptacles substantially rectangular in cross-section, each of which has an open top and is designated to receive a different type of recyclable trash, and each of said receptacles being smaller than its respective compartment so as to be easily stored therein and removed therefrom, and to permit the cover to close the container;

each of said receptacles having a substantially U-shaped handle supported thereby so as to be displaceable to first and second positions, and having a ledge near the top thereof and extending at least partially along the sides from the front to the rear and along the front of the receptacle; and the handle being substantially upright above said ledge when in the first position for grasping the receptacle to store said receptacle in its respective compartment and to remove said receptacle therefrom, and resting on and conforming to said ledge when in the second position when the receptacle is stored in said compartment.

7. Structure as described by claim 6, wherein:

the cover overhangs the front and sides of the container when the container is closed; and the container overhangs the front, rear and sides of the base.

8. Structure as described by claim 1, wherein:

each of the receptacles is smaller than its respective compartment so as to be easily stored therein and removed therefrom, and to permit the cover to close the container.

* * * * *